US005899102A

United States Patent [19]

Ling

[11] Patent Number: 5,899,102

[45] Date of Patent: May 4, 1999

[54] SIMPLIFIED FIREARM LOCK

[76] Inventor: Chong-Kuan Ling, Taipei, Taiwan

[21] Appl. No.: 09/113,013

[22] Filed: Jul. 5, 1998

[51] Int. Cl.[6] ..... E05B 37/02

[52] U.S. Cl. ..... 70/312; 70/202; 70/DIG. 58; 42/70.06; 42/70.07

[58] Field of Search ..... 70/312, 202, 203, 70/23, 26, DIG. 58, 311, 306, 309; 42/70.06, 70.07

[56] References Cited

U.S. PATENT DOCUMENTS

| | | | |
|---|---|---|---|
| D. 393,305 | 4/1998 | Misner et al. | D22/108 |
| 2,742,726 | 4/1956 | Feller | 70/202 |
| 3,624,945 | 12/1971 | Foote | 70/202 |
| 4,499,681 | 2/1985 | Bako et al. | 42/1 |
| 5,125,248 | 6/1992 | Ling | 70/312 |
| 5,487,234 | 1/1996 | Dragon | 42/70.07 |
| 5,535,605 | 7/1996 | Werner | 70/312 |
| 5,638,627 | 6/1997 | Klein et al. | 42/70.07 |
| 5,647,158 | 7/1997 | Eskelinen et al. | 42/70.07 |
| 5,704,152 | 1/1998 | Harrison et al. | 42/70.07 |
| 5,765,409 | 6/1998 | Yang | 70/312 |
| 5,832,647 | 11/1998 | Ling et al. | 42/70.07 |

*Primary Examiner*—Steven Meyers
*Assistant Examiner*—Stephen Grady

[57] ABSTRACT

A simplified firearm lock includes: a male fastening member having a latch formed thereon, a female fastening member having a catch engageable with the latch of the male fastening member to be disposed on opposite sides of a trigger guard of a firearm or handgun, and a locking device provided in the female fastening member for preventing the disengagement of the catch of the female fastening member from the latch of the male fastening member for locking the two fastening members and the trigger of the firearm, whereby upon unlocking of the locking device, the catch will be disengaged from the latch for separating the two fastening members for unlocking the trigger of the firearm.

4 Claims, 2 Drawing Sheets

SIMPLIFIED FIREARM LOCK

BACKGROUND OF THE INVENTION

U.S. Pat. No. 5,647,158 to Conrad W. Eskelinen disclosed a gun trigger lock comprising a pair of complimentary housings that overlay opposite sides of the gun trigger guard. However, it still has the following drawbacks:

1. For unlocking the pair of complimentary housings, the release button (26) is straightly depressed to retract the latch plate (40) having teeth (38) formed thereon. The depression force on the button (26) is directly applied to tension the spring (46) when retracting the latch plate (40) without the aid of any force-saving mechanism, such as a biasing lever or linkage device having long arm of force. So, it requires a heavy force for depressing the button (26) when unlocking the gun lock.
2. The locking and unlocking mechanism is complex. For instance, a lock plate (60) should be further provided between the chords (52) and the latch plate (40), thereby increasing the installation inconvenience and the production cost.
3. The release button (26) is resiliently provided at a side portion of the housing especially adapted for the depression by a user's thumb, but limiting the unlocking orientations and increasing unlocking inconvenience.

The present inventor has found the drawbacks of the conventional gun trigger lock and invented the present simplified firearm lock.

SUMMARY OF THE INVENTION

The object of the present invention is to provide a simplified firearm lock including: a male fastening member having a latch formed thereon, a female fastening member having a catch engageable with the latch of the male fastening member to be disposed on opposite sides of a trigger guard of a firearm or handgun, and a locking device provided in the female fastening member for preventing the disengagement of the catch of the female fastening member from the latch of the male fastening member for locking the two fastening members and the trigger of the firearm, whereby upon unlocking of the locking device, the catch will be disengaged from the latch for separating the two fastening members for unlocking the trigger of the firearm.

DETAILED DESCRIPTION

Figure 1:
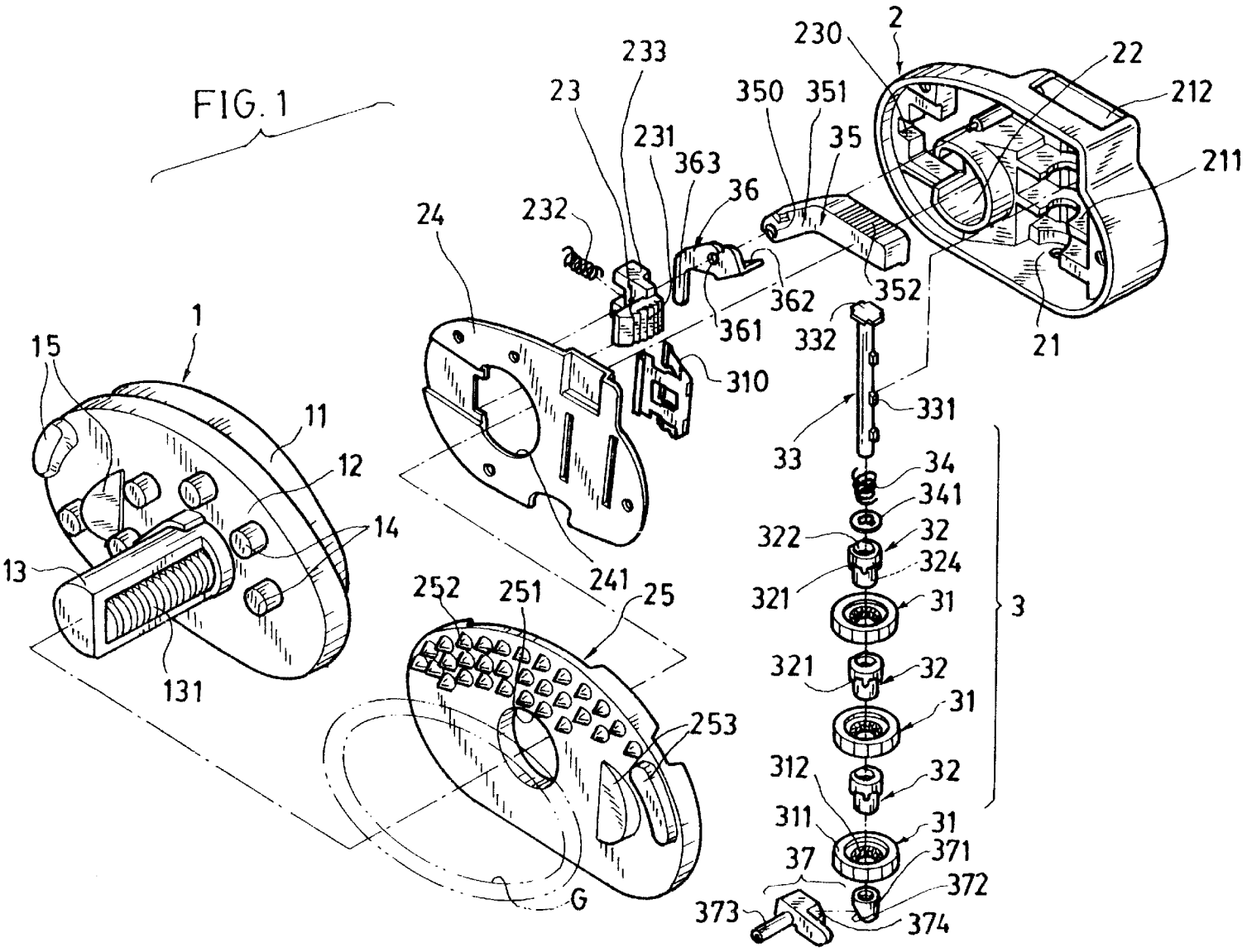
FIG. 1 is an exploded view showing the elements in construction of the present invention.
Figure 2:
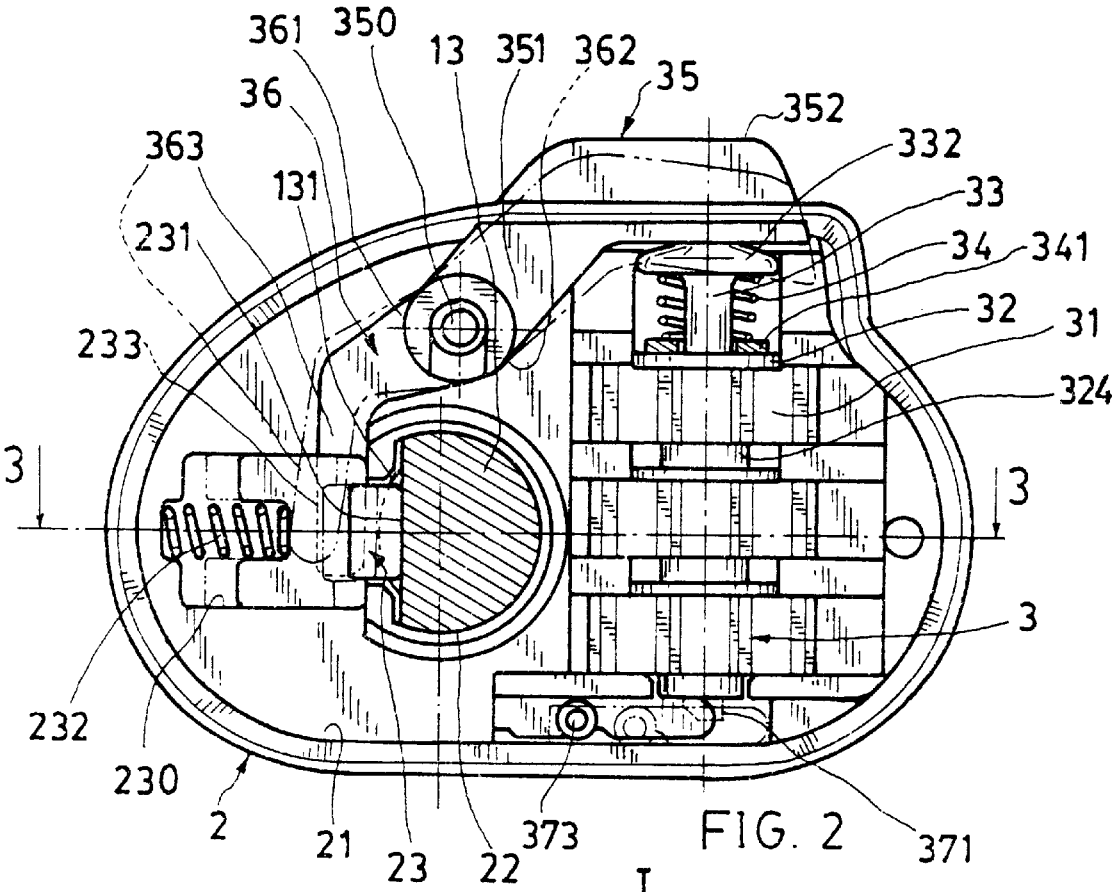
FIG. 2 is a partial longitudinal sectional drawing of the present invention when the latch of the male fastening member is engaged with the female fastening member.
Figure 3:
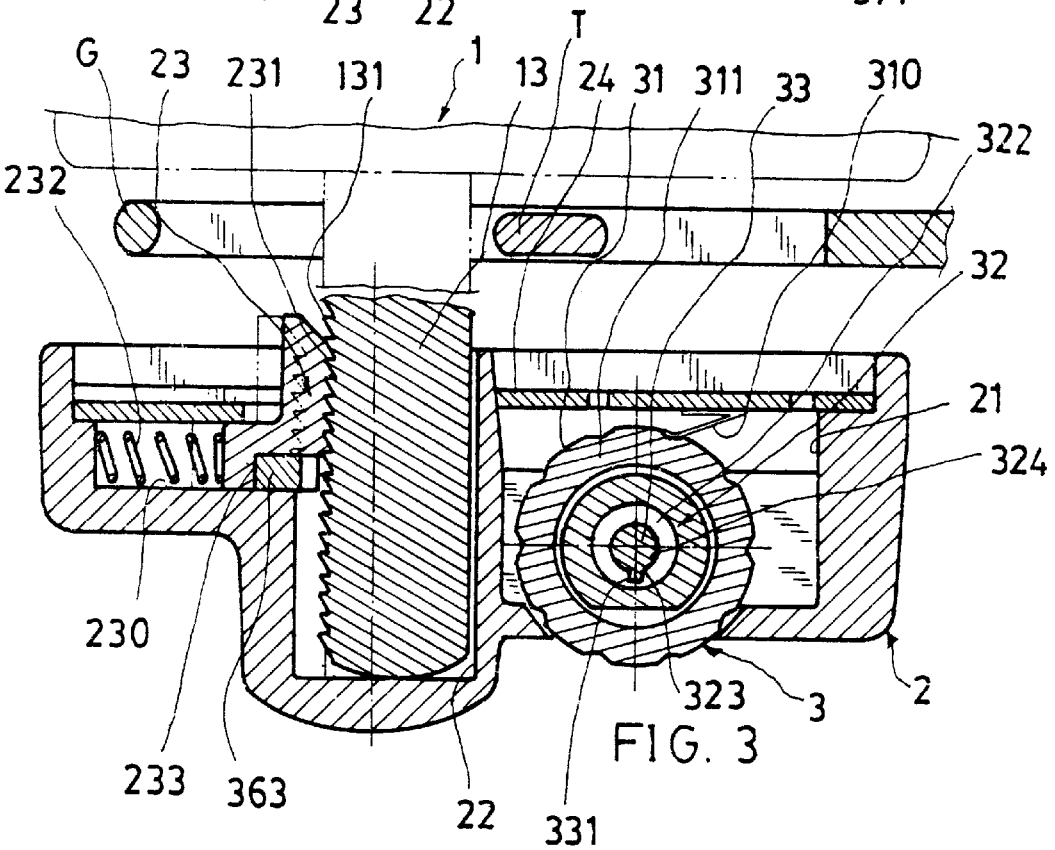
FIG. 3 is a partial cross sectional drawing of the present invention showing the engagement of the latch of the male fastening member with the catch of the female fastening member.

As shown in FIGS. 1–3, the firearm or handgun lock of the present invention comprises: a male fastening member 1, a female fastening member 2 corresponding to the male fastening member 1 disposed on opposite sides of a trigger guard G of a firearm or handgun, and a locking means 3 provided in the female fastening member 2.

The male fastening member 1 includes: a male cover 11 encased with an elastomeric cap 12 on the male cover 11, a latch 13 protruding from the male cover 11 having a plurality of ratchet teeth 131 formed on the latch 13, a plurality of protrusions 14 formed on the elastomeric cap 12, and at least a pair of retaining protrusions 15 formed on a side portion of the male fastening member 1 for retaining the trigger guard G of the firearm or handgun in cooperation with the female fastening member 2.

The female fastening member 2 includes: a female cover 21 having a latch sleeve 22 recessed inwardly in the female cover 21 for inserting the latch 13 of the male fastening member 1 into the latch sleeve 22, a catch 23 having a plurality of ratchet teeth 231 formed on the catch and resiliently held in a sliding groove 230 recessed in the female cover 21 for engaging the ratchet teeth 131 formed on the latch 13, a bottom plate 24 encasing the female cover 21, and an elastomeric cap 25 covering the bottom plate 24 and having a plurality of protrusions 252 formed on the cap 25 for frictionally clamping the trigger guard G and a trigger T of the firearm or handgun in between the two elastomeric caps 25, 12 in cooperation with the protrusions 14 formed on the elastomeric cap 12 of the male cover 11 and having at least a pair of retaining protrusions 253 formed on a side portion of the elastomeric cap 25 for retaining the trigger guard G therein.

The bottom plate 24 and the elastomeric cap 25 are each formed with a latch hole 241, 251 respectively in the plate 24 and the cap 25 for inserting the latch 13 of the male fastening member 1 through the latch holes 241, 251.

The catch 23 is resiliently held in the sliding groove 230 as tensioned by a tensioning spring 232 to let the ratchet teeth 231 on the catch 23 to be engaged with the ratchet teeth 131 on the latch 13, allowing a one-way insertion of the latch 13 into the latch sleeve 22 in the female cover 21, but preventing a rearward retraction of the latch 13 unless when unlocking the present invention by disengaging the catch 23 from the latch 13.

The locking means 3 may be a combination lock as shown in FIGS. 1–3, or other modifications, not limited in the present invention.

The locking means 3 includes: a plurality of dials 31 and sleeves 32 rotatably mounted on a bolt 33 longitudinally formed in a socket 211 in the female cover 21, a tensioning spring 34 normally urging a head portion 332 of the bolt 33 outwardly to contact an actuating lever 35 which is pivotally mounted in and outwardly protruding from the female cover 21, and a seesaw lever 36 pivotally linked with the actuating lever 35 and operatively retracting the catch 23 to be disengaged from the latch 13 upon depression of the actuating lever 35 when the locking means 3 is unlocked.

Each dial 31 is formed with Arabic number on an annular ring 311 of the dial 31, and a plurality of teeth 312 on an inner surface of the annular ring 311. A spring plate 310 is retained in the female cover 21 for resiliently urging the dial 31 for sensing a rotation of the dial 31 during dialing operation.

Each sleeve 32 includes: a plurality of teeth 321 engageable with the teeth 312 annularly formed in each dial 31 for a synchronous rotation of the sleeve 32 and the dial 31, an annular extension 322 annularly formed on an inside wall of each sleeve 32 for retarding each projection 331 formed on the bolt 33 when the locking means 3 is locked, a through slot 323 longitudinally notched in the annular extension 322 for passing the projection 331 of the bolt 33 when unlocked, and a central hole 324 formed in a central portion of the annular extension 322 for engaging the bolt 33.

The bolt 33 is formed with a head portion 332 on an outer end of the bolt 33 to be tensioned by a tensioning spring 34 retained on a washer 341 rested upon an outermost sleeve 32 to normally urge the head portion 332 of the bolt 33 and the actuating lever 35 outwardly to protrude a depression portion 352 of the actuating lever 35 outwardly through a button hole 212 formed in a side portion (top or bottom side) of the female cover 21 ready for a depression of the actuating lever 35 of the present invention for unlocking purpose.

The actuating lever 35 includes: a pivot 350 secured in the female cover 21 for pivotally mounting an inner driving portion 351 of the actuating lever 35 in the female cover 21, and a depression portion 352 formed on an outer portion of the actuating lever 35 and protruded outwardly through a button hole 212 formed in a side portion of the female cover 21; with the inner driving portion 351 operatively biasing the seesaw lever 36 for retracting the catch 23 for unlocking the two fastening members 1,2.

The seesaw lever 36 includes: a central portion 361 pivotally secured in the female cover 21 by the pivot 350, a biasing lug 362 formed on an outer portion of the seesaw lever 36 to be depressed by the inner driving portion 351 of the actuating lever 35 when depressing the actuating lever 35 for unlocking the locking means 3, and a pushing pawl 363 formed on an inner portion of the seesaw lever 36 and engageable with a recess 233 recessed in the catch 23, whereby upon a depression on the biasing lug 362 by the actuating lever 35, the pushing pawl 363 will be biased to retract the catch 23 from the latch 13 for disengaging the male and female fastening members 1, 2 for unlocking purpose (dotted line in FIG. 2).

When depressing the actuating lever 35 in order for unlocking the present invention, the dials 31 and sleeves 32 are rotated to an unlocking (opening) combination to allow the through slots 323 in the sleeves 32 to be aligned with the projections 331 formed on the bolt 33 (FIG. 3), whereby upon depression on the depression portion 352, the projections 311 on the bolt 33 will no longer be retarded by the annular extensions 322 on the sleeves 32, allowing a depression of the actuating lever 35, which is normally rested upon the bolt 33, for biasing the seesaw lever 36 for unlocking the two fastening members 1,2 (dotted line of FIGS. 3,2) for unlocking the present invention.

When releasing the depression of the actuating lever 35, the tensioning spring 33 will restore the head portion 332 upwardly (or outwardly), while the tensioning spring 232 will urge the catch 23 to re-engage the latch 13 as solid line shown in FIGS. 2,3. Upon rotation of the dials to a locking combination, the present invention will then be locked for preventing intrusion in the trigger guard G of a gun for locking the trigger T for safety or security purpose.

The present invention further includes: a combination-changing means 37 as shown in FIGS. 1,2 including a bottom plunger 371 having a sloping surface 372 formed on a lower portion of the plunger 371, and a driving member 373 having a sloping surface 374 formed on an inside portion of the driving member 373 and engageable with the sloping surface 372 of the bottom plunger 371, whereby upon a sliding movement of the driving member 373 to allow the sloping surface 374 to thrust the sloping surface 372 of the plunger 371, the plunger 371 will be driven upwardly to disengage the sleeves 32 from the dials 31, when unlocked, for a free rotation of the dials for resetting a new combination.

The present invention is superior to the conventional trigger lock of gun with the advantages of: a simpler construction with decreased elements for a low cost and easy assembly and maintenance; and an ergonomic unlocking operation by depressing the lever 35*a* (FIG. 2), or by rotating the locking core 31*a* of the locking means 3,3*a*. The depression of the lever 35*a* (FIG. 2) can be effected with a lighter force by the longer arm of force of the lever 35*a* for easily unlocking the present invention.

The present invention may be modified without departing from the spirit and scope of the present invention.

I claim:

1. A firearm lock comprising:

a male fastening member having a latch formed thereon;

a female fastening member corresponding to said male fastening member and having a catch resiliently held in said female fastening member for normally engaging said latch of said male fastening member for locking a trigger guard and a trigger of a firearm; and a locking means formed in said female fastening member for preventing disengagement of said catch from said latch for locking the male and female fastening members; said locking means including an actuating lever pivotally mounted in said female fastening member and normally engageable with said catch; whereby upon unlocking of said locking means, said actuating lever operatively retracts said catch from said latch for unlocking said male and female fastening members; and wherein said locking means includes: a plurality of dials and sleeves rotatable mounted on a bolt longitudinally formed in a female cover of said female fastening member, a tensioning spring normally urging a head portion of the bolt outwardly to contact said actuating lever which is pivotally mounted in and protruded outwardly from the female cover, said sleeves retarding an inward depression of said bolt when locked and allowing a depression of said bolt when unlocked, and a seesaw lever pivotally linked with the actuating lever and operatively retracting the catch to be disengaged from the latch upon depression of the actuating lever when the locking means is unlocked.

2. A firearm lock according to claim 1, wherein said bolt has said head portion formed on an outer end of the bolt and tensioned by a tensioning spring retained on a washer rested upon an outermost sleeve of said sleeves to normally urge the head portion of the bolt and the actuating lever outwardly to protrude a depression portion of the actuating lever outwardly through a button hole formed in a side portion of the female cover ready for a depression of the actuating lever for unlocking the said two fastening members.

3. A firearm lock according to claim 1, wherein said actuating lever includes: an inner driving portion, a pivot secured in the female cover for pivotally mounting the inner driving portion of the actuating lever on the female cover, and a depression portion formed on an outer portion of the actuating lever and protruded outwardly through a button hole formed in a side portion of the female cover; with the inner driving portion operatively biasing the seesaw lever for retracting the catch for unlocking the two fastening members.

4. A firearm lock according to claim 3, wherein said seesaw lever includes: a central portion pivotally secured in the female cover by the pivot, a biasing lug formed on an outer portion of the seesaw lever and operatively depressed by the inner driving portion of the actuating lever when depressing the actuating lever for unlocking the locking means, and a pushing pawl formed on an inner portion of the seesaw lever and engageable with a recess recessed in the catch, whereby upon depression of the actuating lever to actuate the biasing lug, the pushing pawl is biased to retract the catch from the latch for disengaging the male fastening member from said female fastening member.

* * * * *